US006921321B2

(12) United States Patent
Morita

(10) Patent No.: US 6,921,321 B2
(45) Date of Patent: Jul. 26, 2005

(54) GRINDING METHOD AND GRINDING MACHINE

(75) Inventor: Hiroshi Morita, Hoi-gun (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 150 days.

(21) Appl. No.: 10/383,740

(22) Filed: Mar. 10, 2003

(65) Prior Publication Data

US 2003/0236059 A1 Dec. 25, 2003

(30) Foreign Application Priority Data

Jun. 20, 2002 (JP) ..... 2002-180009

(51) Int. Cl.[7] ..... B24B 1/00
(52) U.S. Cl. ..... 451/60; 451/446; 451/449
(58) Field of Search ..... 451/36, 37, 48, 451/57, 60, 450, 53, 446, 449

(56) References Cited

U.S. PATENT DOCUMENTS 3,628,293 A * 12/1971 Kobayashi et al. ..... 451/450
3,834,088 A * 9/1974 Matson ..... 451/450
4,619,081 A * 10/1986 Lipanski ..... 451/450
6,305,183 B1 * 10/2001 Mukai et al. ..... 62/376
2004/0005844 A1 * 1/2004 Morita et al. ..... 451/53

FOREIGN PATENT DOCUMENTS

FR 1 339 254 10/1963
FR 2 752 182 2/1998
JP 361241065 A * 11/1986 ..... B24B/55/02

* cited by examiner

*Primary Examiner*—Dung Van Nguyen
(74) *Attorney, Agent, or Firm*—Oblon, Spivak, McClelland, Maier & Neustadt, P.C.

(57) ABSTRACT

In the grinding process, grinding fluid is supplied toward the grinding point where a workpiece is ground with a grinding wheel. At the same time, a fluid jet is ejected across the air flow above the grinding point in the rotational direction of the grinding wheel. As a result, the air layers on both lateral sides of the grinding wheel are turned not to head for the grinding point above the same, whereby the grinding fluid is reliably led to the grinding point without being obstructed by the air layers following both lateral sides of the grinding wheel.

9 Claims, 11 Drawing Sheets

GRINDING METHOD AND GRINDING MACHINE

INCORPORATION BY REFERENCE

The present application claims priority under 35 U.S.C. .sctn.119 to Japanese Patent Application No. 2002-180009, filed on Jun. 20, 2002. The content of this application is incorporated herein by reference in its entirety.

BACKGROUND OF THE INVENTION

1. Field of the Invention

The present invention relates to a grinding method of and a grinding machine for grinding a workpiece with a rotating grinding wheel wherein grinding fluid is reliably led to the grinding point.

2. Description of the Related Art

Conventionally, there have been used some kinds of grinding machines, for example as shown in FIGS. 10 and 11, in which a grinding wheel G rotates at a high speed for higher grinding efficiency. In these grinding machines, although an air layer flows along and around the grinding wheel G, the air so flowing must be cut off in order to ensure that the grinding fluid reliably led to a grinding point where a workpiece W is ground with the grinding wheel G. FIG. 10 shows a first conventional grinding machine wherein the grinding fluid is pressurized and ejected to the grinding point from a nozzle 40 at such a high speed that the air layer can be cut off to lead the grinding wheel to the grinding point reliably. FIG. 11 shows a second conventional grinding machine wherein the spout of a nozzle 41 faces to the circumferential surface of the grinding wheel G at the right angle. Therefore, the grinding fluid is perpendicularly ejected against the circumferential surface of the grinding wheel G so that the air layer flowing around the grinding wheel can be cut off to lead the grinding fluid to the grinding point reliably.

The inventors of the present invention found out that the air flow flows faster at axial end portions on the circumferential surface of the grinding wheel G than at the middle thereof. This is because air layers of flowing air on both lateral sides of the grinding wheel G are spirally and acceleratively drown in the rotational direction by its rotation from the rotational center to the circumferential surface and thus affect the air flows at the axial end portions of the circumferential surface. This makes the cause to partly obstruct leading the grinding fluid to the grinding point. Especially, where the peripheral velocity of the grinding wheel G is increased to high speeds such as 120 m/s or more for high grinding efficiency, or where the thickness of the grinding wheel G is thin, the foregoing drawback occurs remarkably. In these cases, it becomes hard to lead the grinding fluid to the grinding point reliably. In the second conventional grinding machine, the grinding fluid ejected from the nozzle 41 is able to cut off the air flow on the circumferential surface of the grinding wheel G and is put thereto to be led to the grinding point. However, since the air flows on both lateral sides of the grinding wheel G affect those at the axial end portions of the circumferential surface, the grinding fluid is hardly put on the circumferential surface and whereby it does not reach the grinding point. In the first conventional grinding machine, since the grinding fluid is pressurized for being led to the grinding point, there must be consumed much volume of the grinding fluid. Accordingly, there must be used a high pressure pump and a large tank for the grinding fluid, whereby the facility must be of high cost.

In addition, the grinding fluid and electric power are increased in consumption which causes the maintenance cost to increase.

SUMMARY OF THE INVENTION

Accordingly, what is a primary object of the present invention is to provide a grinding method and a grinding machine in which a workpiece is ground with a grinding wheel while grinding fluid is led to the grinding point without being obstructed by the air flow rotating with grinding wheel.

According to the present invention, there is provided a grinding method or a grinding machine in which the grinding fluid is supplied toward the grinding point where the workpiece is ground with the grinding wheel and an air layer of flowing air on a lateral side of the grinding wheel is drawn its rotation. And a fluid jet is ejected across the air flow above the grinding point in the rotational direction of the grinding wheel. As a result, the air layer on the lateral side of the grinding wheel is turned not to head for the grinding point whereby the grinding fluid is reliably led the grinding point.

Preferably, a baffle plate is attached beside the lateral side of the grinding wheel with a little clearance. The baffle plate is disposed at a little above the fluid jet in the rotational direction of the grinding wheel and parallels the direction of the fluid jet. Thus, the air flow on the lateral side of the grinding wheel can be effectively cut off by the baffle plate.

Moreover, the baffle plate and fluid jet are directed along a hypothetical chord of an arc region, a part of the grinding wheel, including the grinding point. Therefore, the air flow toward the arc region can be cut off more effectively.

A further fluid jet is ejected across the circumferential surface of the grinding wheel above the grinding point. Therefore, the fluid jet cuts off an air layer following the circumferential surface so that the grinding fluid is more reliably led to the grinding point.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, wherein the same reference numerals designated identical or corresponding parts throughout several views and in which.

DESCRIPTION OF THE PREFERRED EMBODIMENTS

Figure 1:
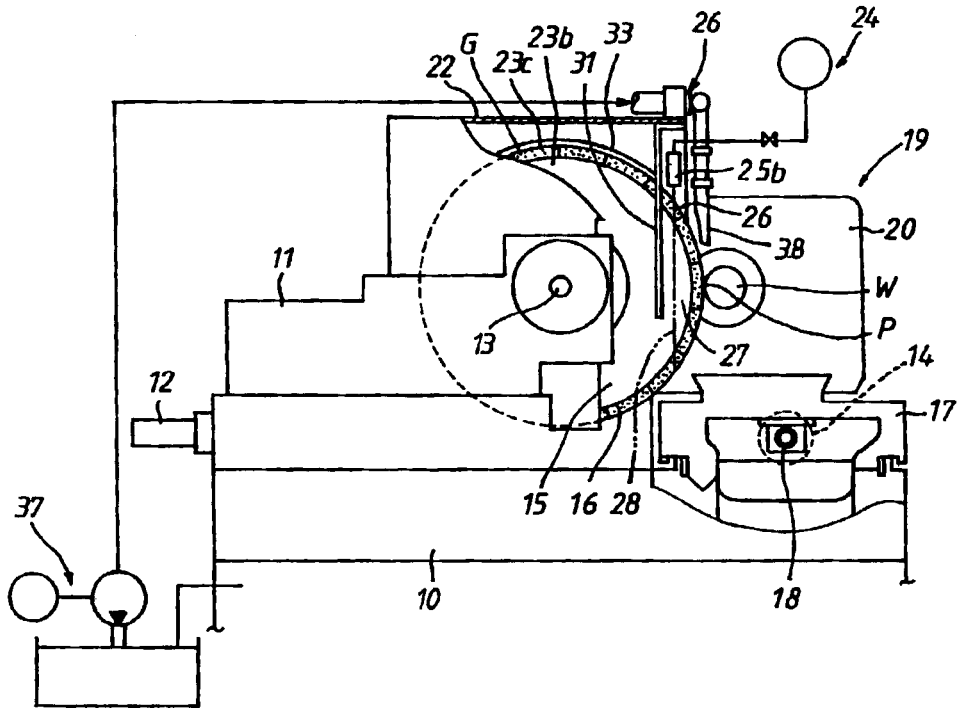
FIG. 1 is a side view partly in section of a grinding machine including a baffle device for baffling an air layer of flowing air according to a first embodiment of the present invention.
Figure 2:
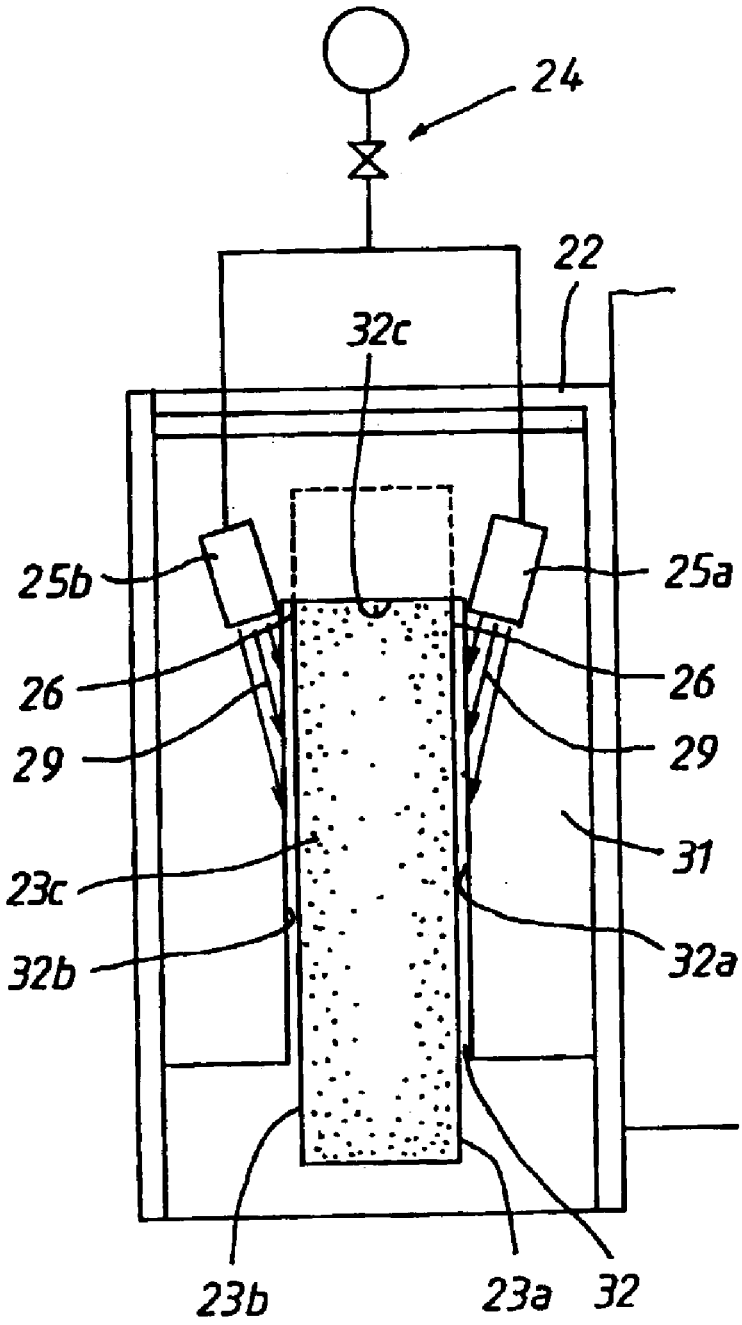
FIG. 2 is a front view of the baffle device according to the first embodiment.
Figure 3:
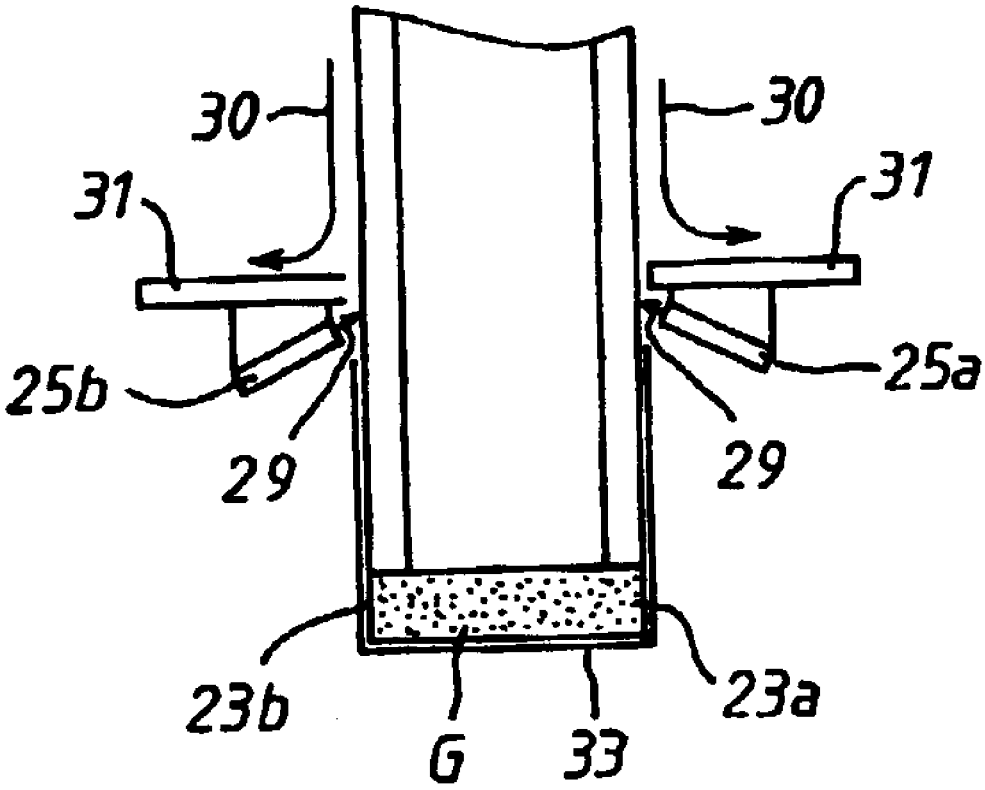
FIG. 3 is a partial plane view of the baffle device according to the first embodiment shown in FIG. 2.
Figure 4:
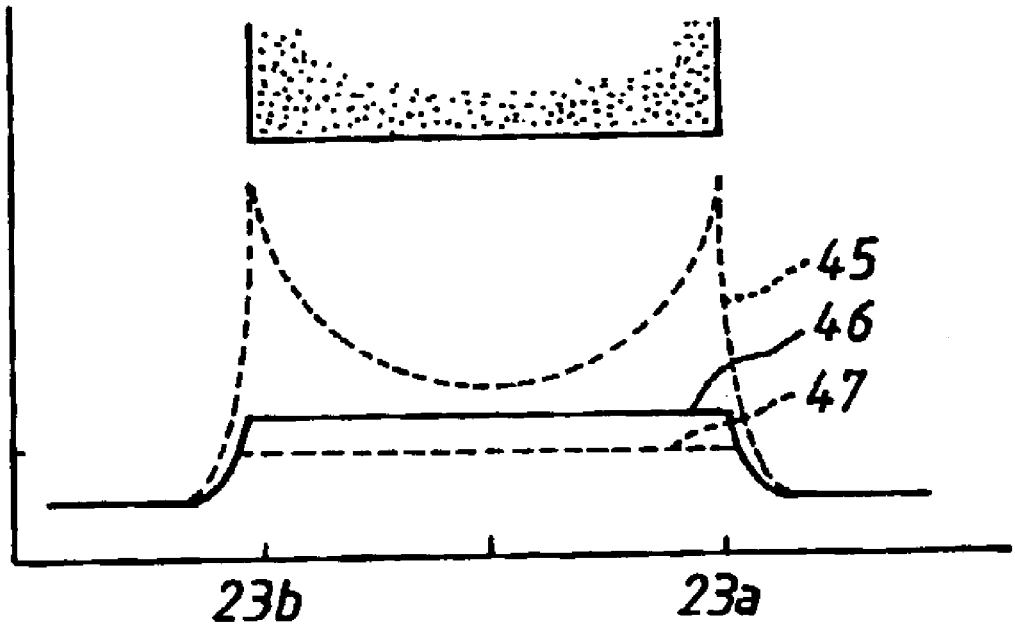
FIG. 4 is a graph showing the flow velocity in the air layer of flowing air rotating with a grinding wheel.

A first embodiment of the present invention will be described with reference to FIGS. 1 to 4. A wheel head 11 is slidably guided on a bed 10 and is drivingly connected with a servomotor 12 through a ball screw mechanism (not shown) so as to be moved toward and away from a workpiece W along X-axis. A spindle 13 with a grinding wheel G is rotatably borne in the wheel head 11 and is rotated by a motor (not shown). The grinding wheel G is composed of a disk core 15, made of a metal like iron or aluminum, and abrasive segments 16 adhered to the circumferential surface of the disk core 15. A table 17 is slidably guided on the bed 10 and is connected with a servomotor 14 through a ball screw mechanism 18 so as to be moved along Y-axis perpendicular to the X-axis. There is mounted a workpiece supporting device 19 including a head stock 20 and a tail stock (not shown) on the table 17. A workpiece W is supported by both centers of the head stock 20 and tail stock and is rotated thereby so as to be ground with the grinding wheel G at a grinding point P where the circumferential surface 23*c* of the grinding wheel G contacts with the workpiece W.

A guard 22 with a baffle plate 31 (referred to later) is fixed to the wheel head 11 to cover the grinding wheel G. Side nozzles 25*a* and 25*b* of a fluid jet supply system 24 are attached to the baffle plate 22, wherein the spouts of the side nozzles 25*a* and 25*b* oblique downwardly toward the forward part of both lateral sides 23*a* and 23*b* of the grinding wheel G for blowing air jets 29 thereto, respectively. A baffle device is composed of the baffle plate 31 and the fluid jet system 24. Both air jets 29 are blown to cutoff points 26 above the grinding point P in the rotational direction of the grinding wheel G, wherein the cutoff points 26 are on both lateral sides 23*a* and 23*b* close to the circumferential surface 23*c*. Therefrom, each air jet 29 flows along a hypothetical chord 28 of an arc region 27 including the grinding point P, wherein the arc region 27 is a part of the grinding wheel G close to the workpiece W. Each spout of the side nozzles 25*a* and 25*b* obliques a little in a rearward direction of the grinding machine in order to prevent the air jets 29 from reaching the grinding point P along the lateral sides 23*a* and 23*b*. Therefore, an air layer 30 flowing air along each lateral side 23*a* and 23*b* is turned to flow along the baffle plate 31 and is prevented from reaching the arc region 27, wherein the air layer 30 is spirally and acceleratively drawn by the rotating grinding wheel G from its rotational axis to its circumferential surface 23*c*. The ambient air can be used for the fluid jet supply system 24 to be supplied through the side nozzles 25*a* and 25*b*.

A little above than the cutoff point 26 in the rotational direction of the grinding wheel G, the baffle plate 31 is disposed in parallel with the hypothetical chord 28 of the arc region 27 and is attached to the guard 22 which is fixed to the wheel head 11. The baffle plate 31 has an opening 32 whose side portions 32*a* and 32*b* respectively face to the lateral sides 23*a* and 23*b* of the grinding wheel G with a little clearance, wherein each side portion 32*a* and 32*b* exists across a radial line that extends radially of the grinding wheel G to pass the grinding point P and the spindle 13. A bottom 32*c* of the opening 32 faces to the circumferential surface 23*c* of the grinding wheel G with a little clearance in order to substantially prevent the air layer 33 on the circumferential surface 23*c* from reaching the grinding point P. For constant clearance between the bottom 32*c* and circumferential surface 23*c*, the baffle plate 31 can be attached to the guard 22 through a compensation system which automatically compensate the position of the baffle plate 31 for the radial reduction of the grinding wheel G by dressing.

A grinding fluid nozzle 38 of a grinding fluid supply system 37 is attached to the guard 22 and ejects grinding fluid toward the workpiece W or grinding point P where the workpiece W is ground with the grinding wheel G.

The operation of the above grinding machine as constructed above will be described. The wheel head 11 advances upon rotation of the servomotor 12 and the workpiece W is ground with the grinding wheel G rotating at a high speed, for example 160 m/s of the peripheral velocity. In the case that the baffle plate 31 and side nozzles 25*a* and 25*b* are not, each air layer 30 of the flowing air following the lateral sides 23*a* and 23*b* spirally and acceleratively is drawn toward the circumferential surface 23*c* along the lateral sides 23*a* and 23*b*. Therefore, a part of each air layer 30 is added to the air layer 33 following the circumferential surface 23*c* and affects the same to cause those at the axial end portions to flow faster than at other portions. In this case, the air flow speed of the air layer 33 on the circumferential surface 23*c* was measured by the Pitot tube. As shown by the broken line 45 in FIG. 4, the result of such measurement indicated that, the air flow on the circumferential surface 23*c* is faster at the axial end portions than at the middle.

In the first embodiment, the baffle plate 31 and side nozzles 23*a* and 23*b*, whose operations will be described hereinafter, are provided for the grinding machine. At first, the side portions 32*a* and 32*b* of the opening 32 and its bottom 32*c* serve to substantially cut off the air layers 30 and 33 flowing along the lateral sides 23*a* and 23*b* of the grinding wheel G and its circumferential surface 23*c*, respectively. Next, each air jet 29 is obliquely blown toward each cutoff point 26 on the lateral sides 23*a* and 23*b* close to the circumferential surface 23*c*. This causes the air layers 30 flowing to turn downwardly thereby to flow along the chord 28 of the arc region 27. Therefore, the air layers 30 passing through the clearances between the baffle plate 31 and both lateral sides 23*a* and 23*b* are prevented from flowing into both arc regions 27. The substantial parts of the air layers 30 and 33 are cut off by means of the baffle plate 31, whereby the remaining parts of thereof are slowed down. Further, the remaining parts of the air layers 30 which pass through the clearances between the baffle plate 31 and both lateral sides 23*a* and 23*b* are hit by the air jets 29 to be turned downwardly. Owing to the air layers 30 and 33 weakened, the flowing air layer 33 following the circumferential surface 23*c* is remarkably slowed down in flowing speed around the grinding point P as shown by the solid line 46 in FIG. 4. This ensures that the grinding fluid from the grinding fluid nozzle 38 can be reliably led to the grinding point P.

Where the peripheral velocity of the grinding wheel G was set 120 to 160 m/s, 30 to 50 litters of the grinding fluid per minute was necessary in the prior art grinding machine. However, the amount of the supplied grinding fluid was able to be reduced to about 15 to 25 litters per minute in the first embodiment. In this case, since the air jets 29 downwardly flow along the hypothetical chord 28 in the same direction as the grinding wheel G moves at around the grinding point P as shown in FIG. 1, any increase does not take place in the electric power consumption by the motor for driving the spindle. Recently, with the attention paid to the environment preservation, it has been studied to supply the grinding fluid as small as about 300 cc per minute to the workpiece W and to supply lubricant oil like vegetable oil a little to the grinding wheel G. Even where this study is practiced in the first embodiment, the grinding fluid and lubricant oil can be reliably supplied to the workpiece W and grinding wheel G without being obstructed by the air layer 30 and 33 following the grinding wheel G.

Figure 5:
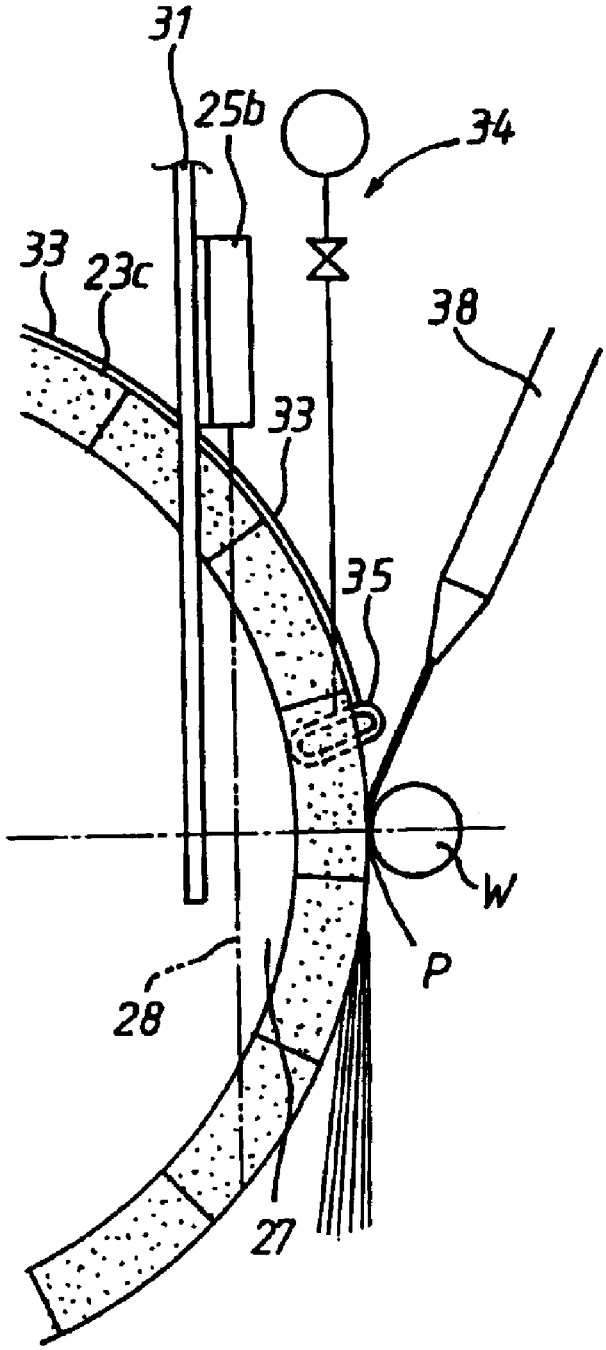
FIG. 5 is a partial side view according to a second embodiment of the present invention.
Figure 6:
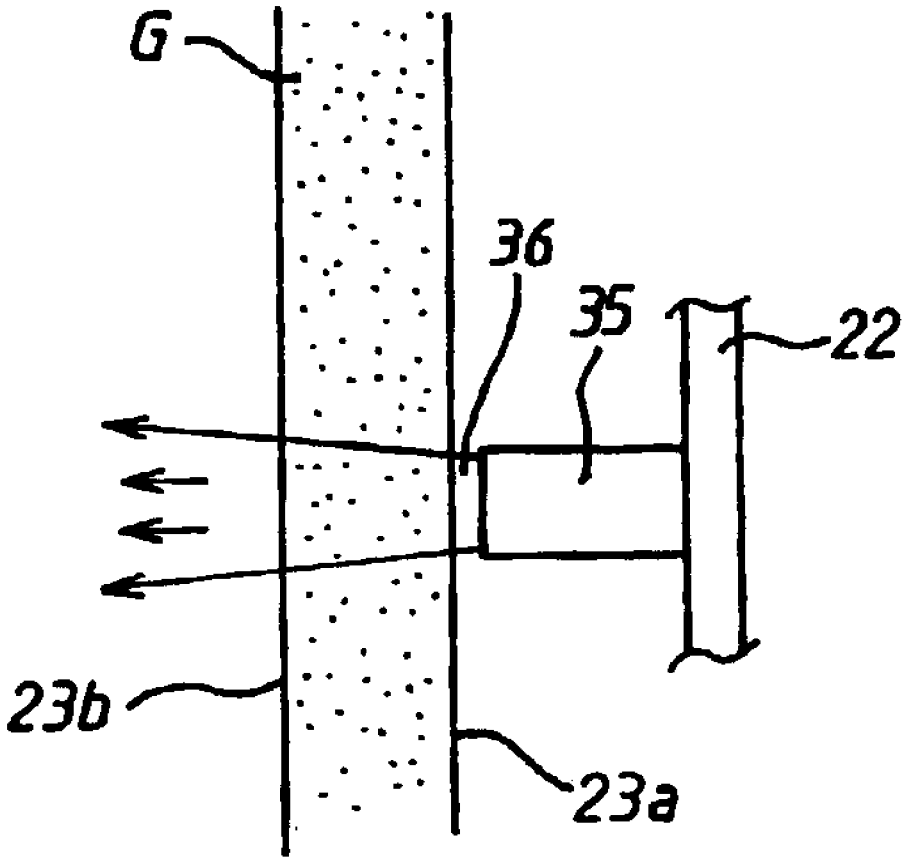
FIG. 6 is a partial front view according to the second embodiment.

A second embodiment of the present invention will be described with reference to FIGS. 5 and 6. The same members and functions of this embodiment as the first one will be omitted from being described.

In addition to the baffle device in the first embodiment, a further fluid jet supply system 34 is provided for blowing an air jet 36 from one lateral side 23*a* to the other side 23*b* across the air layer 33 following the circumferential surface 23*c* of the grinding wheel G. A crossing nozzle 35 of the further fluid jet supply system 34 is horizontally attached to the guard 22 to open toward the front edge of the circumferential surface 23*c* of the grinding wheel G between the grinding point P and its upstream cutoff point 26. Accordingly, the air jet 36 is horizontally blown onto the front edge of the circumferential surface 23*c* from one lateral side 23*a* to the other side 23*b*. To cope with the radial reduction of the grinding wheel G by the dressing, the crossing nozzle 35 takes the form of an ellipse which is elongated in the radial direction, whereby the air jet 36 can be blown onto the front edge of the circumferential surface 23*c* over the entire life of the grinding wheel G. The ambient air can be used for the further fluid jet supply system 34.

In the second embodiment, the crossing nozzle 35 is added to the first embodiment. The amount of the flowing air layer 33 following the grinding wheel G is reduced by the baffle plate 31 and air jets 29 blown from the side nozzles 25*a* and 25*b*. Additionally, the flowing air layer 33 which passed through the baffle plate 31 is turned or carried away by the air jet 36 which is ejected across the flowing direction of the air layer 33, since the air jet 36 is blown from the crossing nozzle 35 to the front edge of the circumferential surface 23*c*. Therefore, the flowing air layer 33 following the circumferential surface 23*c* can be slowed down around the grinding point P more effectively than that in the first embodiment as shown by the broken line 47 in FIG. 4. This advantageously makes the grinding fluid be more reliably led to the grinding point P from the grinding fluid nozzle 38 without being obstructed by the flowing air layers 30 and 33 following the rotating grinding wheel G.

The first and second embodiments described herein above can be utilized in practicing a face grinding and a surface grinding.

Figure 7:
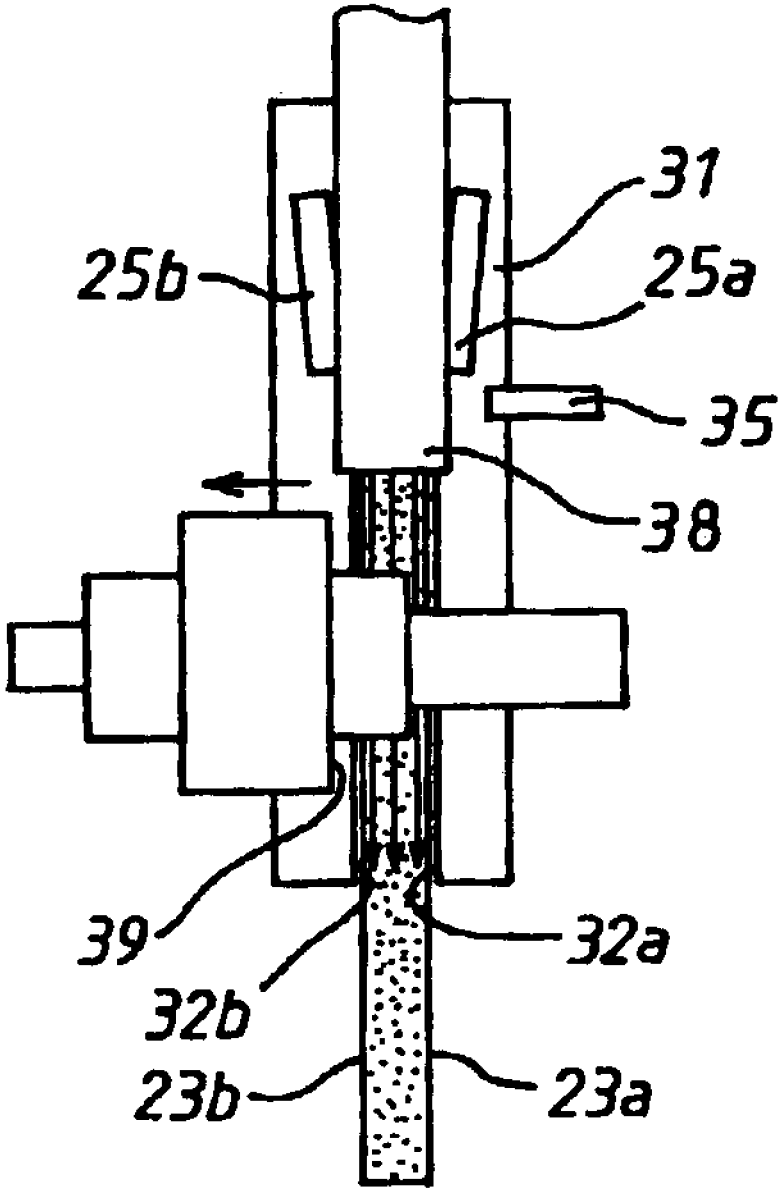
FIG. 7 is a partial front view showing the face grinding for which the first and second embodiments are utilized.
Figure 8:
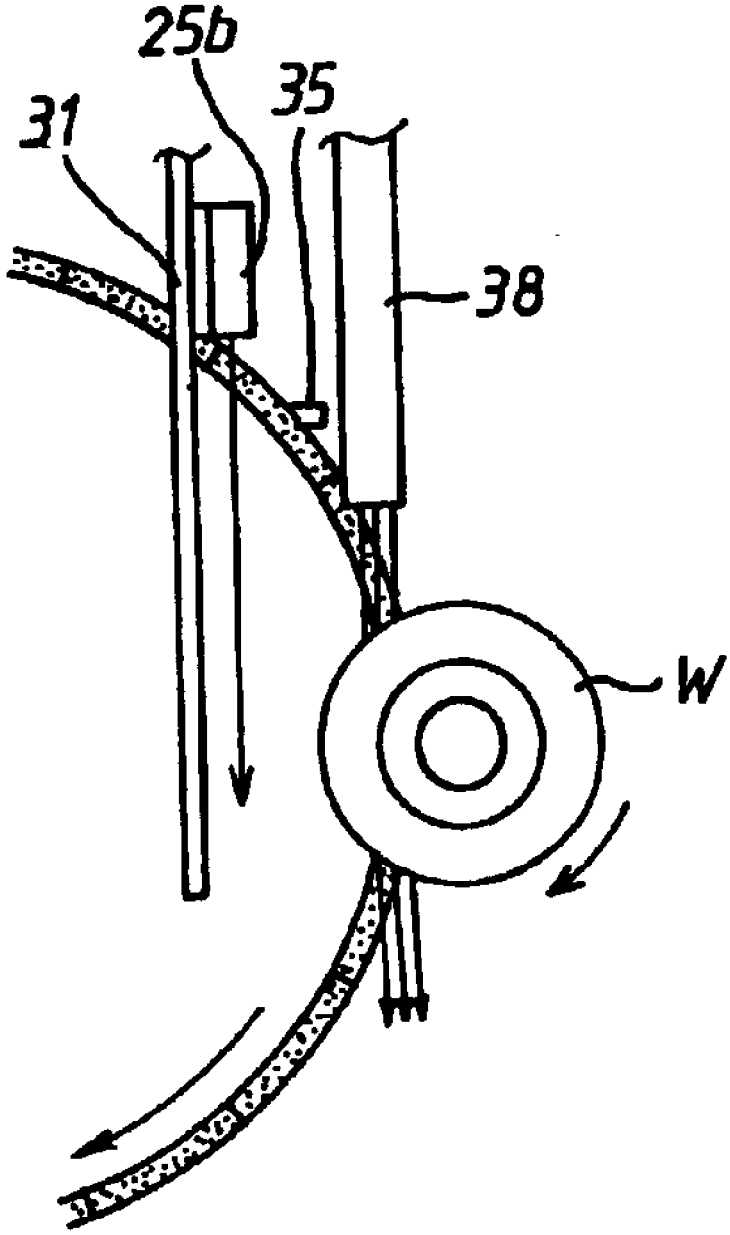
FIG. 8 is a partial side view showing the face grinding shown in FIG. 7.

When the face grinding is practiced as shown in FIGS. 7 and 8, the table 17 is moved by the servomotor 18 along Y-axis to grind an end face 39 of the workpiece W with one lateral side of the abrasive segments 16 on the grinding wheel G. In this case, the flowing air layer 30 following the lateral side 23*b* of the grinding wheel G is substantially cut off by the side portion 32*b* of the baffle plate 31 and is turned downwardly by the air jet 29 blown from the side nozzle 25*b*. Accordingly, since the flowing air layer 30 at the side of face grinding is prevented from reaching another grinding point where the lateral side of the abrasive segments 16 contacts with the end face 39 of the workpiece W, the grinding fluid can be reliably led to such grinding point.

Figure 9:
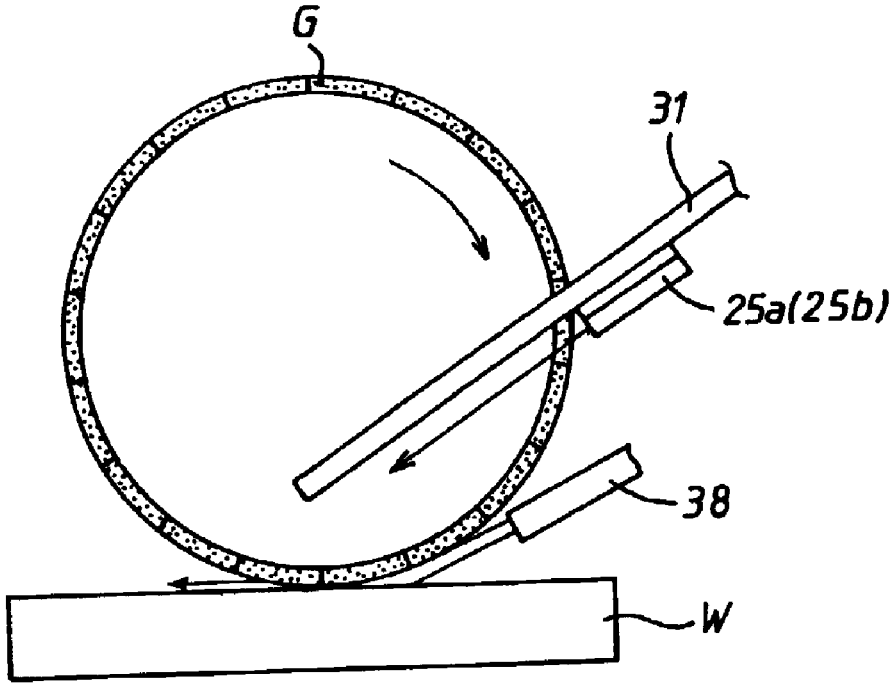
FIG. 9 is a partial side view of a surface grinding machine for which the first and second embodiments are utilized.
Figure 10:
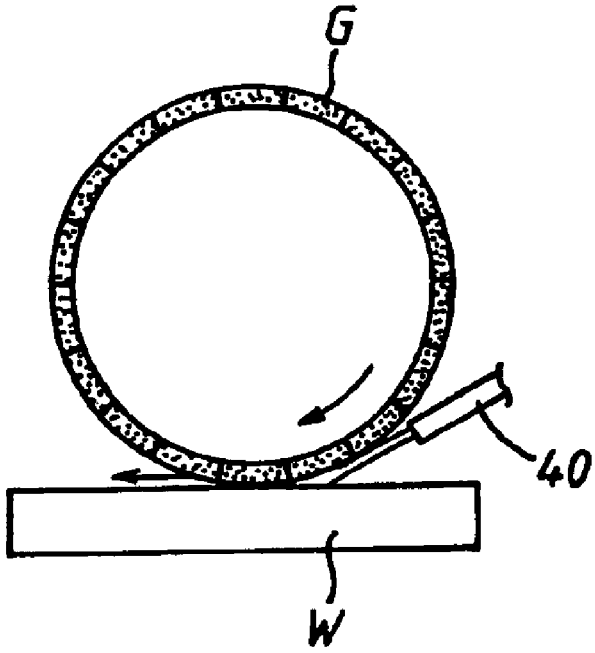
PRIOR ART FIG. 10
FIG. 10 is a partial side view showing a first conventional grinding machine.
Figure 11:
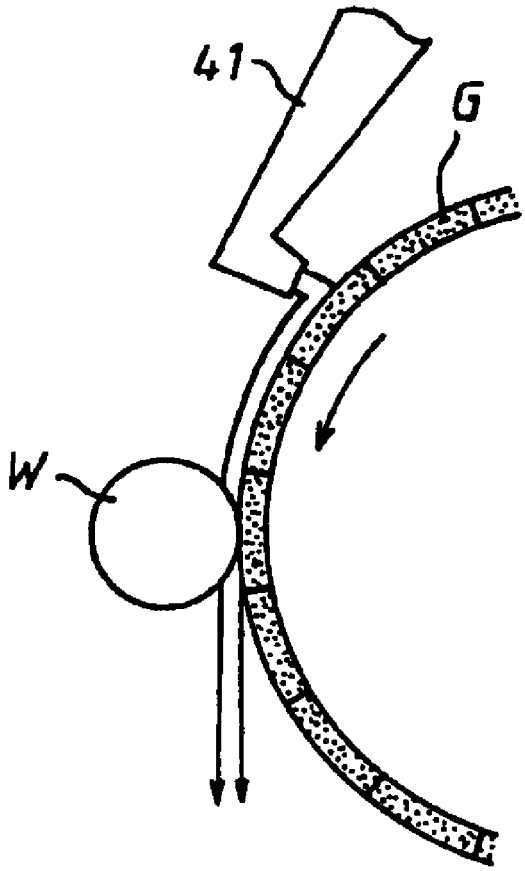
PRIOR ART FIG. 11
FIG. 11 is a partial side view showing a second conventional grinding machine.

Although in the above embodiments, the baffle plate 31 and nozzles 23*a*, 23*b* and 35 are applied to the grinding machine for the cylindrical and face grinding, they can be applied to a surface grinding machine as shown in FIG. 9, a slicing machine, a slit grinding machine, etc. And, various other types of fluid jet such as for example the grinding fluid or mist can be ejected from the nozzles 23*a*, 23*b* and 35 for air jet.

Obviously, numerous modifications and variations of the present invention are possible in light of the above teachings. It is therefore to be understood that within the scope of the appended claims, the present invention may be practiced otherwise than as specifically described herein.

G: grinding wheel
W: workpiece
10: bed
11: wheel head
17: table
22: guard
23*a*, 23*b*: lateral side of the grinding wheel
23*c*: circumferential surface of the grinding wheel
24, 34: fluid jet supply system
25*a*, 25*b*: side nozzle
35: crossing nozzle
29, 36: air jet
26: cutoff point
27: arc region
28: hypothetical chord
30, 33: air layer
31: baffle plate
32: opening of the baffle plate
32*a*, 32*b*: side portion of the opening
32*c*: bottom of the opening
37: grinding fluid supply system
38: grinding fluid nozzle

What is claimed is:

1. A grinding method of grinding a workpiece with a rotating grinding wheel at a grinding point where said grinding wheel contacts with said workpiece, said method comprising the steps of:

blowing a fluid jet to a cutoff point on a lateral side of said grinding wheel above said grinding point in the rotational direction of said grinding wheel, wherein said fluid jet cuts off an air layer of flowing air following said lateral side of said grinding wheel; and supplying grinding fluid toward said grinding point while said fluid jet is blown to said cutoff point.

2. A grinding method according to claim 1 further comprising the steps of blowing a further fluid jet between said grinding point and said cutoff point for cutting off an air layer of flowing air following the circumferential surface of said grinding wheel.

3. A grinding method according to claim 2 further comprising the steps of disposing a baffle plate further above said cutoff point for cutting off said air layer of flowing air following said circumferential surface of said grinding wheel.

4. A grinding method according to claim 1 further comprising the steps of disposing a baffle plate further above said cutoff point for cutting off said air layer of flowing air following said lateral side of said grinding wheel.

5. A grinding machine for grinding a workpiece with a rotating grinding wheel at the grinding point where said grinding wheel contacts with said workpiece, the grinding machine comprising:

a grinding fluid supply system for supplying grinding fluid toward said grinding point; and a fluid jet supply system for blowing a fluid jet toward a cutoff point on a lateral side of said grinding wheel above said grinding point in the rotational direction of said grinding wheel so as to cut off an air layer of flowing air following said lateral side of said grinding wheel.

6. A grinding machine according to claim 5 further comprising a further fluid jet supply system including a crossing nozzle opening toward the front edge of the circumferential surface of said grinding wheel between said grinding point and said cutoff point for cutting off an air layer of flowing air following the circumferential surface of said grinding wheel.

7. A grinding machine according to claim 5 further comprising a baffle plate disposed further above said cutoff point to face to said lateral side of said grinding wheel with a little clearance for cutting off said air layer of flowing air following said lateral side of said grinding wheel.

8. A grinding machine according to claim 7, wherein said baffle plate and said fluid jet are directed along a hypothetical chord of an arc region of said grinding wheel including said grinding point.

9. A grinding machine according to claim 5 further comprising a baffle plate disposed further above said cutoff point to face to said circumferential surface of said grinding wheel with a little clearance for cutting off said air layer of flowing air following the circumferential surface of said grinding wheel.

* * * * *